US009616327B2

(12) United States Patent
Rucker et al.

(10) Patent No.: US 9,616,327 B2
(45) **Date of Patent: *Apr. 11, 2017**

(54) TOY APPARATUS

(71) Applicant: Mattel, Inc., El Segundo, CA (US)

(72) Inventors: James Austin Rucker, Pawtucker, RI (US); Derek S. Handy, Hawthorne, CA (US); Scott H. Derman, Los Angeles, CA (US)

(73) Assignee: Mattel, Inc., El Segundo, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/003,147

(22) Filed: Jan. 21, 2016

(65) Prior Publication Data

US 2016/0136518 A1 May 19, 2016

Related U.S. Application Data

(63) Continuation-in-part of application No. 14/954,796, filed on Nov. 30, 2015, which is a continuation of (Continued)

(51) Int. Cl.
*A63H 33/30* (2006.01)
*A63F 9/30* (2006.01)

(Continued)

(52) U.S. Cl.
CPC ..... *A63F 9/30* (2013.01); *A63F 7/0668* (2013.01); *A63H 33/00* (2013.01); *A63H 33/30* (2013.01);

(Continued)

(58) Field of Classification Search
USPC ..... 446/330, 352, 353, 376, 390, 424, 425, 446/426; 434/258; 273/447; 244/100, (Continued)

(56) References Cited

U.S. PATENT DOCUMENTS 1,191,124 A 7/1916 Cotton
1,489,581 A 4/1924 Lynch (Continued)

FOREIGN PATENT DOCUMENTS

WO 2010123631 A2 10/2010

OTHER PUBLICATIONS

Notice of Allowance dated Sep. 4, 2015 for U.S. Appl. No. 14/189,815.

(Continued)

*Primary Examiner* — Kurt Fernstrom
(74) *Attorney, Agent, or Firm* — The Mueller Law Office, P.C.

(57) ABSTRACT

A toy apparatus includes a base piece configured to slide on a surface when an initial pushing force is applied to the toy. A base elongated member is coupled to the base piece, and has a distal end away from the base piece. A movable elongated member has a first end and a second end, and is movable between an open first position and a closed second position. A tether is coupled to the first end of the movable elongated member, wherein tension applied to the tether moves the movable elongated member. In the open first position, the second end of the movable elongated member is away from the distal end of the base elongated member. In the closed second position, the second end is closer to the distal end, and the base elongated member and the movable elongated member are capable of retaining a target piece.

18 Claims, 12 Drawing Sheets

Related U.S. Application Data application No. 14/189,815, filed on Feb. 25, 2014, now Pat. No. 9,227,148.

(60) Provisional application No. 61/769,532, filed on Feb. 26, 2013.

(51) Int. Cl.

| | |
|---|---|
| ***A63H 33/00*** | (2006.01) |
| ***A63F 7/06*** | (2006.01) |
| *A63F 3/00* | (2006.01) |
| *A63F 11/00* | (2006.01) |

(52) U.S. Cl.

CPC ..... *A63F 2003/00908* (2013.01); *A63F 2011/0076* (2013.01); *A63F 2250/128* (2013.01); *A63F 2250/482* (2013.01); *A63F 2250/491* (2013.01)

(58) Field of Classification Search

USPC ..... 244/104, 115

See application file for complete search history.

(56) References Cited

U.S. PATENT DOCUMENTS 2,526,612 A 10/1950 Rudolf
3,265,429 A 8/1966 Shatt
3,572,703 A 3/1971 Greene
3,583,702 A * 6/1971 Glass ..... A63F 9/00 273/108
3,669,427 A 6/1972 Curtis
3,721,440 A 3/1973 Burns
3,728,816 A 4/1973 Ensmann et al.
3,951,405 A 4/1976 Long
4,005,897 A 2/1977 Smith
4,229,003 A 10/1980 Shimizu
4,244,138 A 1/1981 Holahan et al.
4,244,568 A 1/1981 Ferris et al.
4,248,468 A 2/1981 Hastings
4,307,533 A 12/1981 Sims et al.
4,469,327 A 9/1984 Ulrich et al.
4,585,425 A 4/1986 Amici et al.
4,603,860 A 8/1986 Wey
4,638,997 A 1/1987 Clark
4,650,192 A 3/1987 Todokoro
4,674,223 A 6/1987 Pearce
4,773,643 A 9/1988 Mizunuma
4,778,433 A 10/1988 McKay et al.
4,813,670 A * 3/1989 Mizunuma ..... A63F 9/30 273/447
4,838,553 A 6/1989 Chaun-Tien
4,854,626 A 8/1989 Duke
4,944,512 A 7/1990 Mauck et al.
4,961,580 A 10/1990 Yoe et al.
4,995,606 A 2/1991 Kashimoto
5,028,047 A 7/1991 Lee et al.
5,163,863 A 11/1992 Goldfarb et al.
5,193,808 A 3/1993 Takeshi
5,295,694 A 3/1994 Levin
5,340,120 A 8/1994 Holyoak
5,342,064 A 8/1994 Williamson et al.
5,370,432 A 12/1994 Kram
5,378,188 A 1/1995 Clark
5,415,417 A 5/1995 Reis
5,435,568 A 7/1995 Black
5,458,342 A 10/1995 Hernandez
5,478,269 A 12/1995 Wolfram
5,503,442 A * 4/1996 Lee ..... E01H 1/1206 294/1.4
5,525,090 A * 6/1996 Halford ..... A63H 17/045 446/330
5,566,949 A 10/1996 Gorden
5,607,196 A 3/1997 Weger
5,651,717 A 7/1997 Hamilton et al.
5,722,663 A 3/1998 Avigal et al.
5,752,704 A 5/1998 Todokoro
5,964,638 A 10/1999 Emerson
6,099,381 A 8/2000 Sodeshima
6,200,190 B1 3/2001 Reynolds
6,481,714 B1 11/2002 Jacobs
6,554,702 B2 4/2003 Mahar et al.
6,601,851 B1 8/2003 Sakamoto et al.
6,623,010 B1 9/2003 Holland
6,634,940 B2 10/2003 Yoshida et al.
6,652,352 B1 11/2003 MacArthur et al.
6,789,798 B1 9/2004 Adams et al.
6,843,477 B2 1/2005 Simmons
6,938,899 B2 9/2005 Kenney et al.
7,258,343 B2 8/2007 Hayakawa et al.
7,469,901 B1 12/2008 Hilliard
7,695,342 B1 4/2010 Cameron et al.
7,934,724 B1 5/2011 Esquivel et al.
8,020,873 B2 9/2011 Kuneman
8,042,848 B2 10/2011 Tu
8,181,964 B2 5/2012 Ritter et al.
8,469,361 B2 6/2013 Gress
8,523,648 B2 9/2013 Gilson et al.
8,807,615 B2 8/2014 Kovarik et al.
D720,020 S 12/2014 Chen
9,227,148 B2 1/2016 Rucker et al.
2002/0043764 A1 4/2002 Imhof
2002/0067000 A1 6/2002 Larson et al.
2002/0094753 A1 7/2002 Campos et al.
2003/0137107 A1 7/2003 Rubin
2006/0038349 A1 2/2006 Meeks
2006/0237909 A1 10/2006 Petrovski
2006/0290065 A1* 12/2006 Blagg ..... A63F 9/26 273/447
2012/0049445 A1 3/2012 Ritter et al.
2013/0193701 A1 8/2013 Klenk
2014/0159307 A1 6/2014 Macintyre-Melody
2014/0242874 A1 8/2014 Rucker et al.

OTHER PUBLICATIONS

Office Action dated Jul. 16, 2015 for U.S. Appl. No. 14/189,815.
Office Action dated May 4, 2015 for U.S. Appl. No. 14/189,815.
Office Action dated Jul. 13, 2016 for U.S. Appl. No. 14/954,796.

* cited by examiner

TOY APPARATUS

RELATED APPLICATIONS

The application is a continuation-in-part of U.S. patent application Ser. No. 14/954,796 filed on Nov. 30, 2015 and entitled "Toy Apparatus"; which is a continuation of U.S. patent application Ser. No. 14/189,815 filed on Feb. 25, 2014 and entitled "Toy Apparatus," issued as U.S. Pat. No. 9,227,148; which claims priority to U.S. Provisional Patent Application No. 61/769,532 filed on Feb. 26, 2013 and entitled "Toy Apparatus"; all of which are hereby incorporated by reference for all purposes.

BACKGROUND

Games in which players retrieve articles are a popular source of entertainment. For example, fishing poles, claws, tethers, and springs have been used to pick up objects such as balls, disks, toy animals such as fish, and other types playing pieces. Game participants gain amusement through the devices with which the play pieces are retrieved, with the varying actions and dexterity that is required.

As the interests of the marketplace change over time, there continues to be a need for unique and innovative games to bring new play value.

SUMMARY

In some embodiments, a toy apparatus includes a base piece configured to slide on a surface when an initial pushing force is applied to the toy. A base elongated member is coupled to the base piece, the base elongated member having a distal end away from the base piece. A movable elongated member has a first end and a second end, the movable elongated member being coupled to the base piece near the first end and being movable with respect to the base piece between an open first position and a closed second position. A tether is coupled to the first end of the movable elongated member, wherein tension applied to the tether moves the movable elongated member from the open first position to the closed second position. In the open first position, the second end of the movable elongated member is away from the distal end of the base elongated member. In the closed second position, the second end of the movable elongated member is closer to the distal end of the base elongated member, and the base elongated member and the movable elongated member are capable of retaining a target piece.

In some embodiments, a game apparatus includes a plurality of target pieces and a plurality of retrieving assemblies. Each retrieving assembly includes a base piece configured to slide on a surface and a base elongated member coupled to the base piece, where the base elongated member has a distal end away from the base piece. The retrieving assembly also includes a movable elongated member and a tether. The movable elongated member has a first end and a second end and is movably coupled to the base piece near the first end. The tether is coupled to the first end of the movable elongated member and extends from the base piece. The movable elongated member has an open first position in which the second end of the movable elongated member is away from the distal end of the base elongated member. The movable elongated member has a closed second position in which the second end of the movable elongated member is closer to the distal end of the base elongated member, where in the closed second position the base elongated member and the movable elongated member are capable of retaining a target piece. Tension applied to the tether moves the movable elongated member from the open first position to the closed second position.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION

Figure 1:
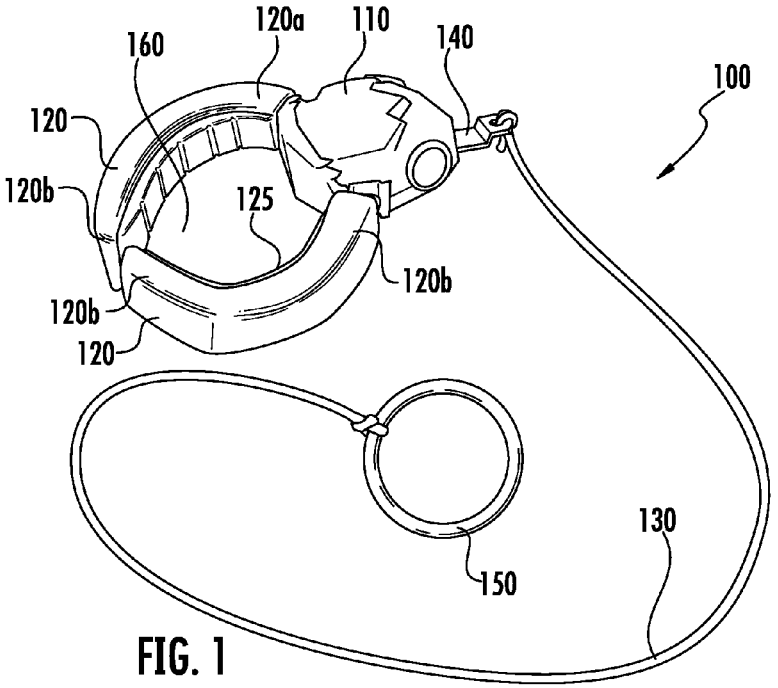
FIG. 1 is a perspective view of an embodiment of a toy apparatus with elongated members closed together.
Figure 2:
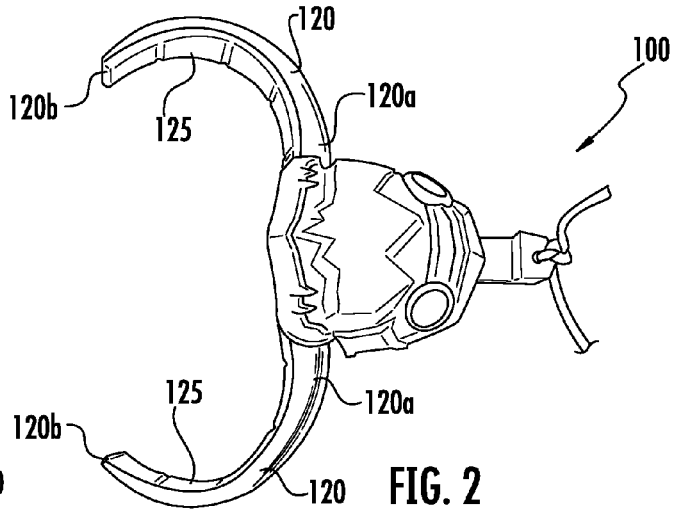
FIG. 2 is a top view of the toy apparatus of FIG. 1 with elongated members expanded apart.
Figure 3:
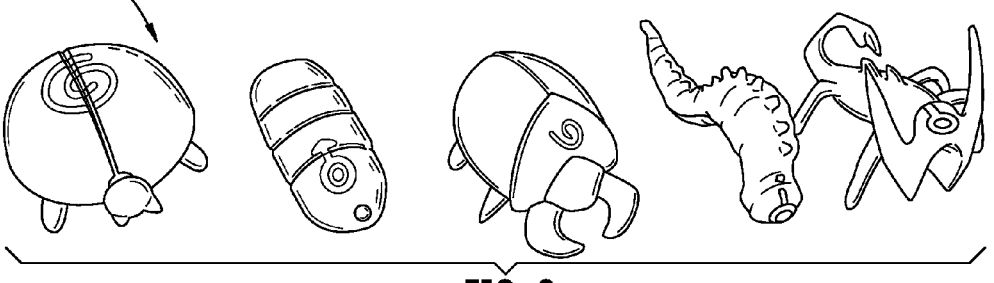
FIG. 3 depicts exemplary target pieces.

FIGS. 1-2 illustrate an exemplary embodiment of a toy 100 that includes a base piece 110, claws 120, and a tether 130. The toy 100 in FIG. 100 is shown as a fantasy creature, with the base piece 110 being shaped as the creature's head and body, and the pincers or claws 120 being shaped as its arms. In other embodiments, the toy 100 may be configured to represent, for example, animals, space aliens, human figures, machinery, spacecraft, vehicles, or other realistic or imaginative items. The claws 120 are elongated members that expand apart and contract together to retrieve objects such as the target pieces 200 of FIG. 3. The claws 120 are configured in FIGS. 1-2 in a curved shape, with the claws 120 having a concave surface 125 that forms a space 160 to surround a target piece. However, in other embodiments the claws 120 may take other forms that are enabled to surround a target piece, such as being linear, angled, or having an irregular contour. For the purposes of this disclosure, "surround" shall mean encompassing a sufficient portion around the target piece such that the target piece cannot fit through any openings between the claws. In the embodiment of FIGS. 1-2, the two claws 120 move in a plane parallel to the surface on which toy 100 is placed, so that they may surround a target object when the claws 120 are closed together. The target pieces 200 are embodied in FIG. 3 as fantasy creatures. However, other embodiments are possible such as animals, military supplies, tools, balls, or other objects that may correspond to the shape of the toy 100 that is being used to retrieve the objects.

In FIG. 1, tether 130 is coupled to a rod 140 extending from the tail section of base piece 110, and terminates in an optional loop 150. Tether 130 may be any flexible material that can impart tension, such as but not limited to a string, a lanyard, or an elastic band. The tether 130 is held by a player's hand, such as by loop 150, or by grasping directly on tether 130. Loop 150 may be designed to fit on an individual finger, or to fit over several fingers. In FIG. 1, loop 150 is embodied as a circular ring and may be rigid or flexible. Loop 150 may be fabricated from, for example, plastic or cloth, and may include fasteners such as hook-and-loop material or snaps to adjust the size of the loop to secure it on a user's hand. In yet other embodiments, loop 150 may be replaced by a handle, knob, or other device to enable the user to maintain control of the tether 130.

In game play, the toy 100 is placed on a surface such as a table, game board, or floor, with target pieces (e.g. pieces 200 of FIG. 3) placed on the surface at a distance away from the user. The toy 100 is slid on the surface, with claws 120 in an expanded or open position, toward the target pieces to capture and retrieve them. The toy 100 may be slid by, for example, a user manually providing an initial pushing force to project the toy 100 across the surface. The user pushes the toy 100 and releases it so that the toy 100 freely slides on the surface due to momentum generated by the initial pushing force. When tension is applied to the tether, whether through the player pulling on the tether 130 or through the momentum of the thrown toy 100 pulling the tether 130 taut, the tension causes the claws 120 to move from their open position to a closed position. That is, in the open position the tips of the claws 120 are in an expanded position away from each other, and in the closed position the tips of the claws 120 contract toward each other. Tension on the tether 130 closes the claws 120 to retrieve a target piece, and pulling on the tether 130 may enable the player to pull the toy 100 back to the player. The tension that moves the claws 120 from the open position to the closed position is applied only to the tether, without a user holding any part of the toy 100. Although in the embodiment of FIG. 1 the tether 130 is coupled to rod 140, which is coupled to the claws 120, in other embodiments the tether 130 may be connected directly to the claws without the presence of rod 140.

For the toy apparatus 100 of FIGS. 1-2, the claws 120 may also be described as movable elongated members with a first end 120*a* coupled to the base piece 110, and a second end 120*b* opposite the first end 120*a*. The toy apparatus 100 may be configured such that in the open first position of FIG. 2, the second ends 120*b* are away from each other, and in the closed second position of FIG. 1, the second ends 120*b* are closer to each other. In the closed second position, the toy apparatus 100 may be configured with the second ends 120*b* in close proximity with each other such that they can pinch the target piece between the second ends 120*b*. For example, the second ends 120*b* may be touching each other or may have a distance between them in the closed second position that is less than a minimum dimension of the target piece. In this manner, the toy apparatus 100 provides multiple options for a user to retrieve a target piece by being able to pinch or grasp a target piece between the second ends 120*b* of the claws 120, in addition to being able to surround the target piece within the space 160.

Figure 4:
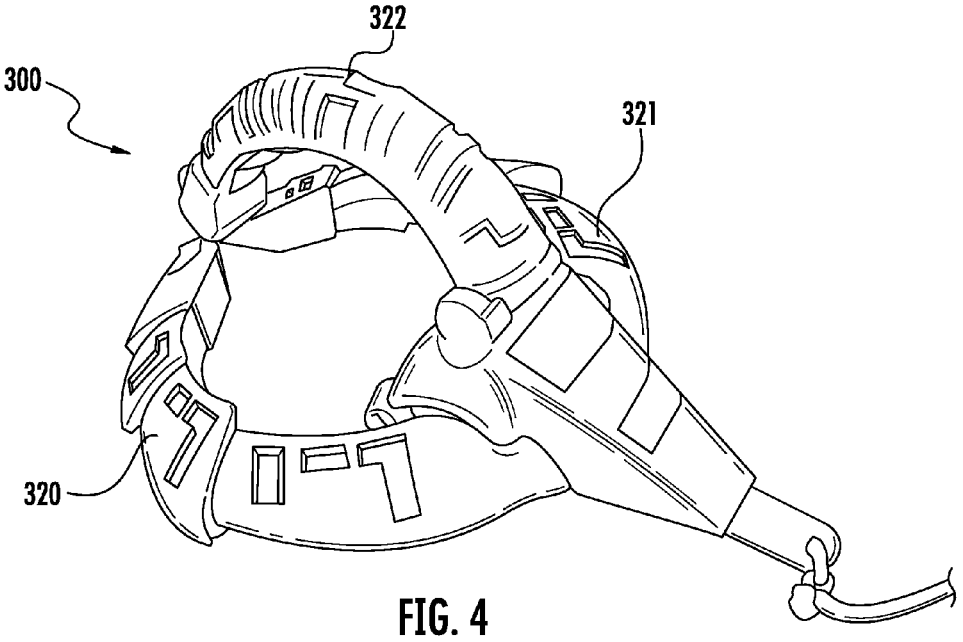
FIG. 4 shows another exemplary toy apparatus with claws closed.
Figure 5:
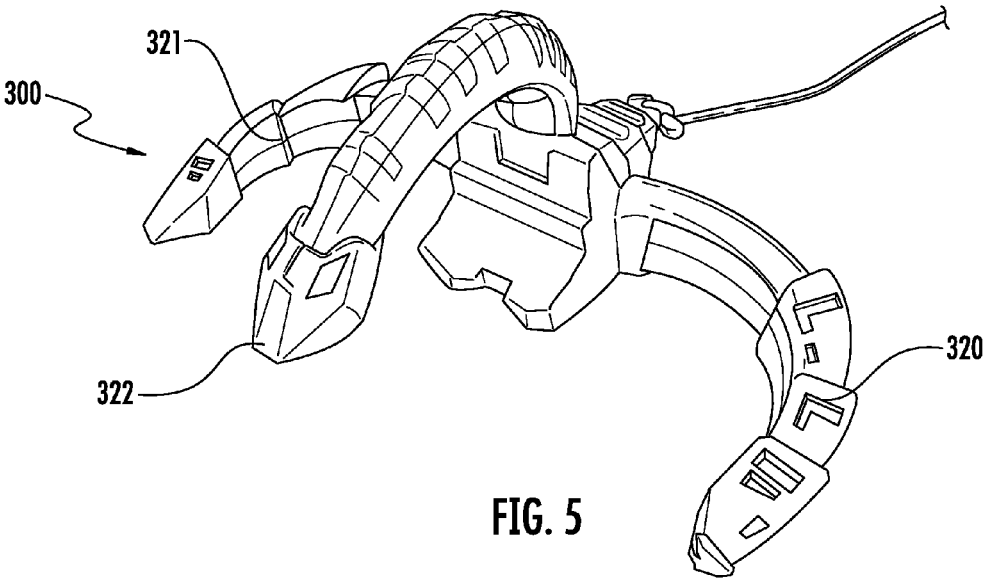
FIG. 5 shows the toy of FIG. 4 with claws open.

FIGS. 4-5 show another embodiment of a toy 300, this embodiment having three claws 320, 321 and 322, instead of two claws as in FIG. 1. FIG. 4 shows the toy in a closed or contracted position, while FIG. 5 shows the toy in an open or expanded position. Claws 320 and 321 move in a plane parallel to its supporting surface, while claw 322 moves in a different plane—which is orthogonal to the surface in this embodiment. The two claws 320 and 321 may assist in providing stability while the toy is being slid during play, in addition to serving as retrieving mechanisms. Having the third claw 322 in a different plane may add play value by allowing different shapes and sizes of objects to be retrieved. In other embodiments, the toy 300 may only have claws similar to claw 322, and not include claws 320 or 321, such that the claw(s) 322 descend from above the playing surface to surround a target object. In such an embodiment, the base (e.g., main body) of the toy 300 may be made wider to provide stability for the toy 300 when it is slid.

Figure 20:
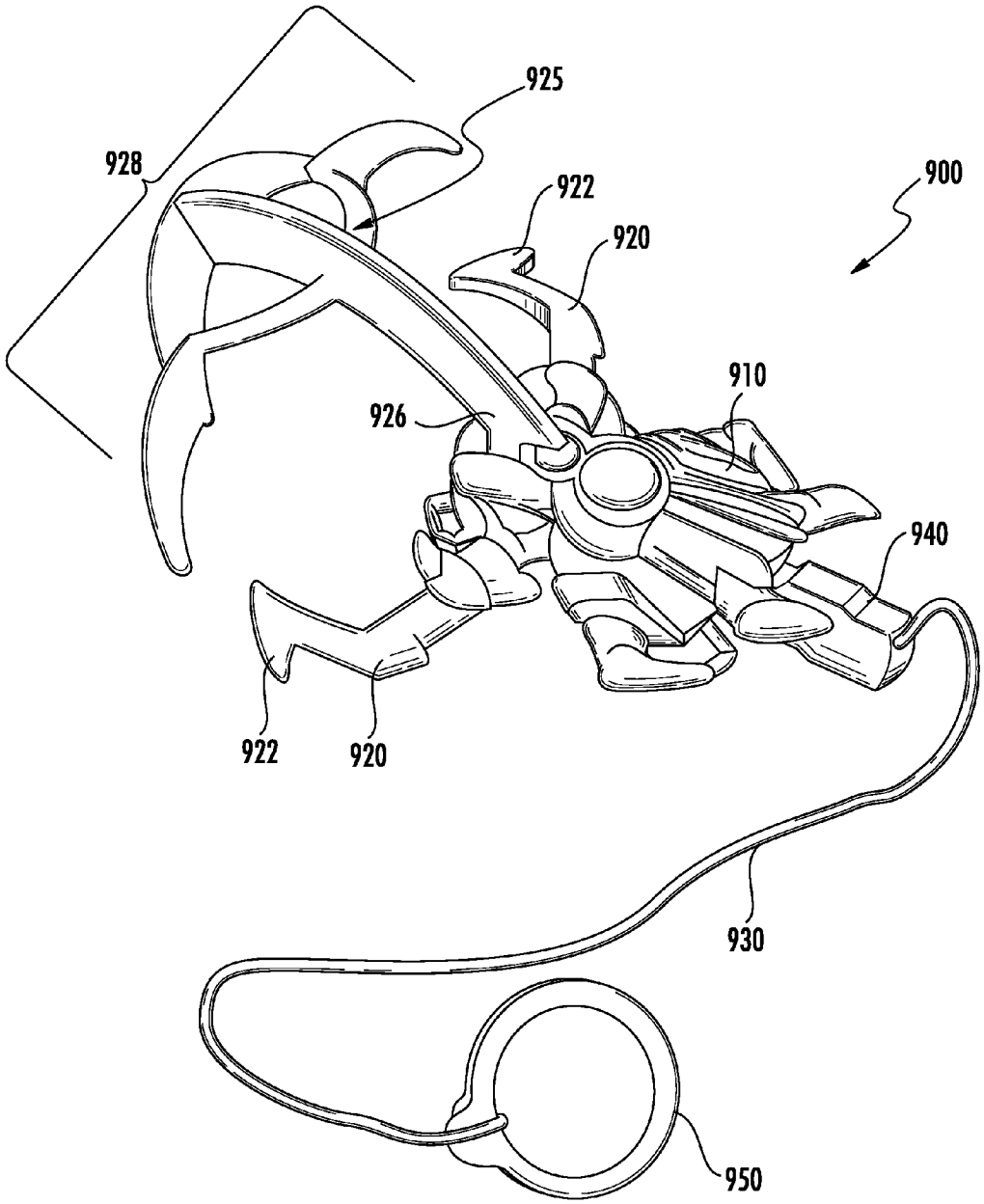
FIG. 20 is a perspective view of another embodiment of a toy apparatus, showing a movable elongated element in an open position.
Figure 21:
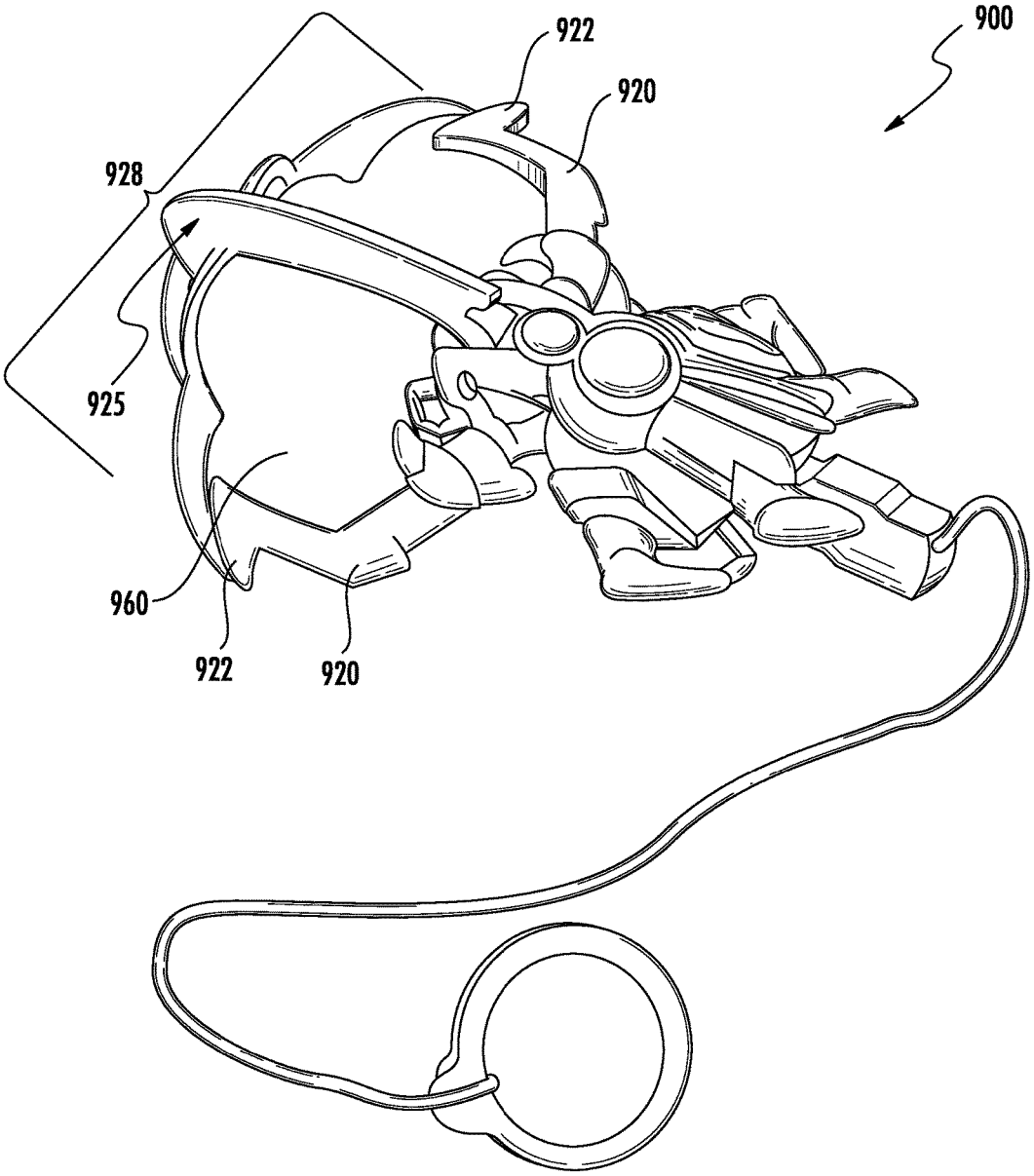
FIG. 21 is a perspective view of the toy apparatus of FIG. 20, showing the movable elongated element in a closed position.

FIGS. 20-21 illustrate another embodiment of a toy apparatus 900. The toy apparatus 900 includes a base piece 910, base elongated members 920, a movable elongated member 925, and a tether 930. Base elongated members 920 and movable elongated member 925 are similar to the claws of the previous embodiments. Each base elongated member 920 is coupled to the base piece 910, with a distal end 922 of the base elongated member 920 being away from the base piece 910. Movable elongated member 925 has a first end 926 and a second end 928, where the movable elongated member 925 is coupled to the base piece 910 near the first end 926. The movable elongated member 925 is movable between an open first position shown in FIG. 20 and a closed second position shown in FIG. 21. Tether 930 is coupled to movable elongated member 925, such as through actuation element 940 in this embodiment. Actuation element 940 may operate as described in previous embodiments, such as by being slidably coupled to base piece 910 in order to actuate the movable elongated member 925 when the tether 930 is pulled.

In this embodiment of FIGS. 20-21, the toy apparatus 900 has two base elongated members 920 fixedly coupled to right and left sides of base piece 910. That is, base elongated members 920 do not move when the actuation element 940 is actuated. The second end 928 of movable elongated member 925 is configured as an extended horizontal piece that spans between the two base elongated members 920. In other embodiments, the second end 928 may be configured in other shapes, and the toy apparatus may include only one base elongated member 920 or a plurality of base elongated members 920. The second end 928 of movable elongated member 925 is away from the distal ends 922 of base elongated members 920 in the open first position of FIG. 20, and is closer to the distal ends 922 of base elongated members 920 in the closed second position of FIG. 21. The movable elongated member 925 is pivotally joined to the base piece 910 at the first end 926 in this embodiment, moving vertically relative to the surface on which the toy apparatus 900 slides when the movable elongated member 925 moves between the open first position and the closed second position. In the closed second position, the base elongated members 920 and movable elongated member 925 are capable of retaining a target piece, such as by pinching the target piece between the second end 928 of movable elongated member 925 and the distal ends 922 of base elongated members 920. Alternatively, a target piece may be retained by being surrounded by the movable elongated member 925 and the base elongated members 920, within the space 960 formed by the claws.

In operation, a user places the toy apparatus 900, which may also be referred to as a retrieving assembly, on a playing surface and urges the toy apparatus 900 toward a target piece by applying an initial pushing force. The pushing force generates momentum, allowing the toy apparatus 900 to freely slide on the surface. The playing surface may be, for example, a table top, a game board, or a floor. The base piece 910 is configured to slide on the surface such as by having a flat bottom surface, or by including features such as wheels or rounded nubs. The toy apparatus 900 is projected across the surface by the initial pushing force, and when the toy apparatus 900 is close to the target piece, tension is applied to the tether 930. The tension may be applied, for example, by the user actively pulling on the tether 930, or the tether 930 may simply become taut as it becomes fully extended. The user may pull directly on the tether 930 or pull via a user control device such as a loop 950, or a handle, strap, or knob. The tension applied to the tether 930 moves the movable elongated member 925 from the open first position to the closed second position. The tension is applied only to the tether 930, without other human contact to the toy apparatus 900. As the user continues to pull on the tether 930, the toy apparatus 900 is pulled toward the user, along with a target piece if the target piece has been successfully retrieved.

In various embodiments, the toy apparatuses of the present disclosure may have different numbers of claws and decorated with different designs. Toy 100 has two claws, toys 300 and 900 have three claws, and toy 600 (FIG. 8) has four claws. Other numbers of claws are possible, with different arrangements of the claws. For example, the claws may be unevenly spaced apart, rather than the symmetrical arrangement shown in the present figures. In another example, the claws may have different lengths from each other, such as an upper claw being shorter than the lower two.

Figure 6:
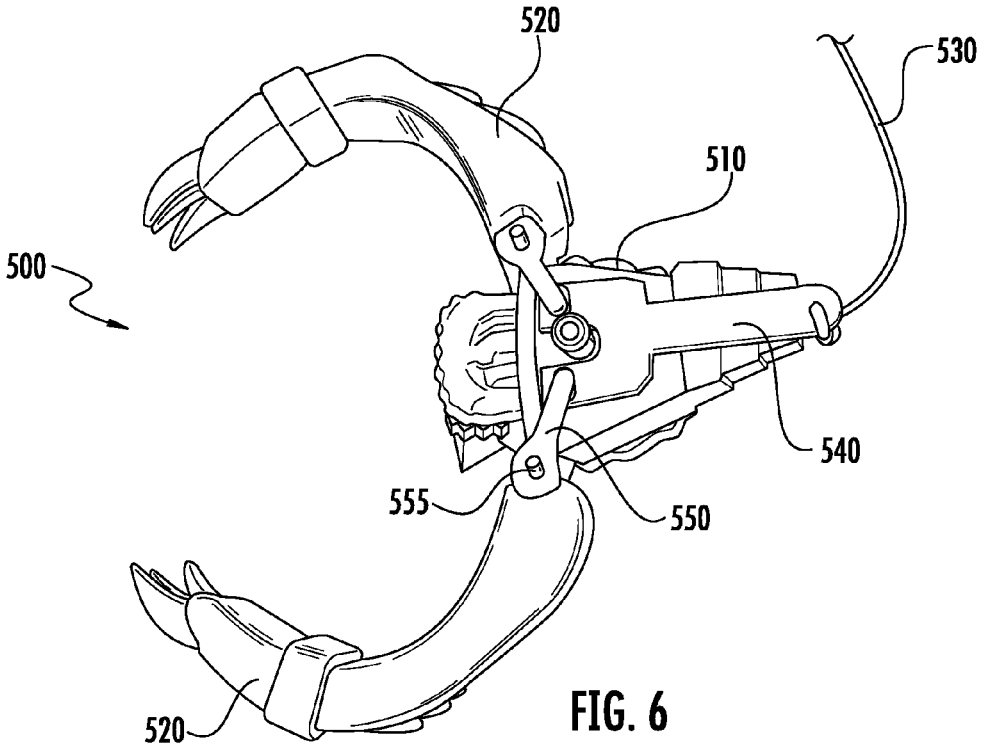
FIG. 6 is a bottom view of an exemplary apparatus, showing components involved with moving the claws.
Figure 7:
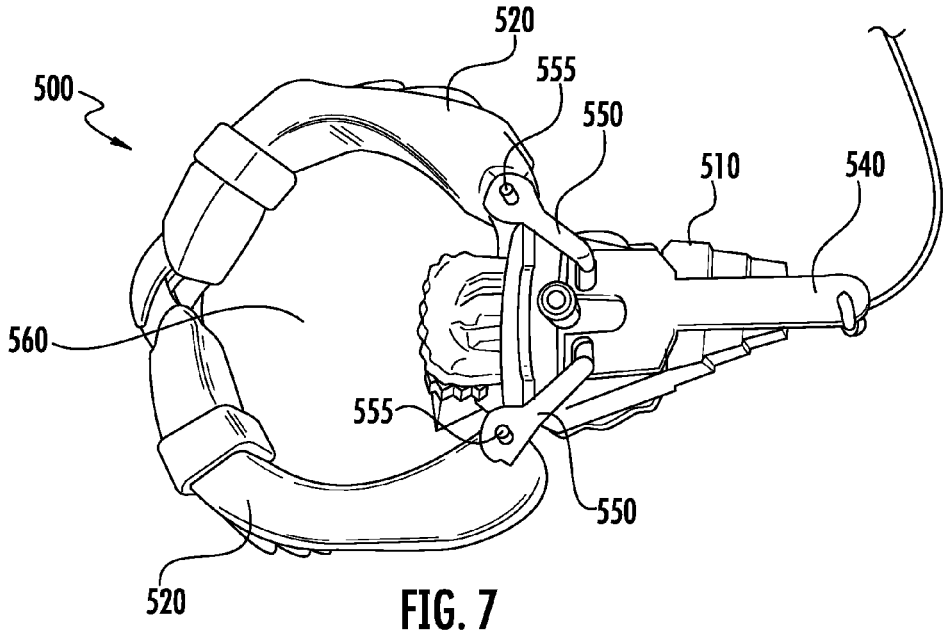
FIG. 7 shows the toy of FIG. 6, with claws in a closed position.

FIGS. 6-7 provide views of the mechanisms of a toy 500 that includes a body or base piece 510, claws 520, a tether 530, an actuation element 540, and linkages 550. FIG. 6 is a view of the underside of the assembly when the pincers 520 are open, such as when the toy 500 is ready to deploy to capture a playing piece. FIG. 7 shows the same view with pincers 520 closed, where the pincers 520 form an area 560 that is capable of surrounding the playing piece. Note that although the tips of pincers 520 are shown as forming a closed area 560 in this embodiment, in other embodiments the tips need not contact each other. That is, some space may remain between the tips of pincers 520, as long as the gap is small enough to retain the playing piece in area 560.

In FIGS. 6-7, the claws 520 are movably coupled to base piece 510, using pin joints 555 to enable a pivoting motion in this embodiment. In other embodiments, the pivoting movement may involve the use of ball joints, hinges, and the like. Linkages 550 couple the claws 520 to actuation element 540, where actuation element 540 is shown in this embodiment as a flat rod that slides within base piece 510 in this embodiment. When tension is applied to the tether 530, either by active pulling from a user or by the transfer of momentum when the toy 500 reaches the extent of its travel and the tether 530 becomes taut, the tension causes actuation element 540 to be pulled partially out of base piece 510. This movement of the actuation element 540 then causes the linkages 550 to pivot and move claws 520 from their open position to their closed position. The linkages 550 are depicted in FIGS. 6-7 as rod-shaped arms, but other shapes are possible without departing from the scope of this disclosure. Note that in other embodiments, the actuation element 540 may be omitted and tether 530 may be directly coupled to pincers 520. In yet further embodiments, actuation element 540 may optionally include a sleeve or a coating to facilitate movement of actuation element 540 within base piece 510.

Figure 8:
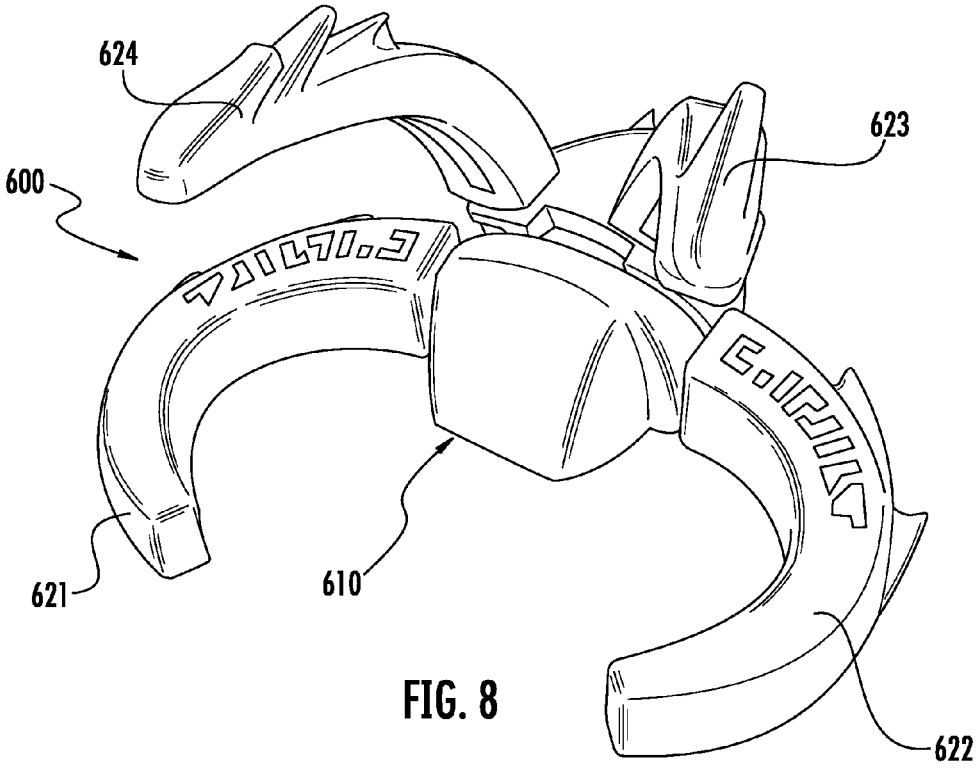
FIG. 8 is a perspective view of another embodiment of a toy apparatus.
Figure 9:
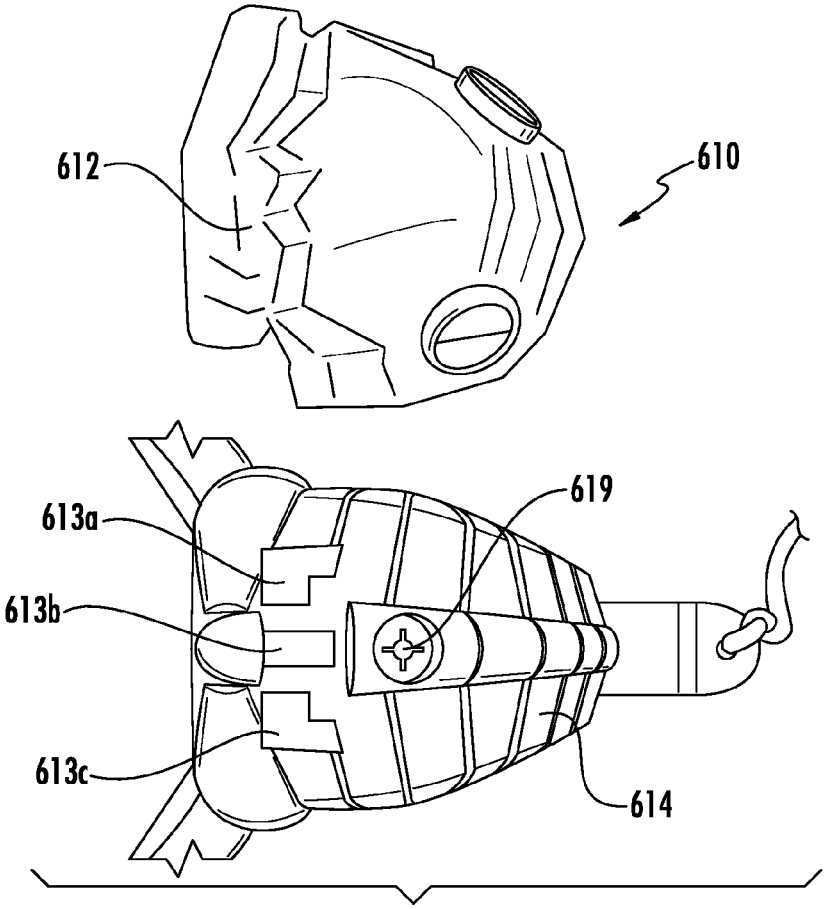
FIG. 9 is a top view of an exemplary base piece and head piece.
Figure 10:
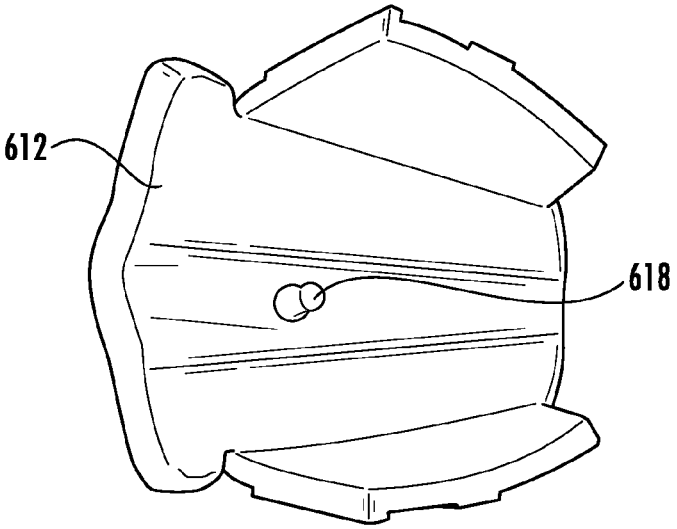
FIG. 10 is a bottom view of the head piece of FIG. 9.

FIGS. 8-17 provide detailed views of components of a toy 600, in another embodiment. In FIG. 8 the toy 600 includes a base piece 610 and four claws 621, 622, 623 and 624. Claws 623 and 624 are removable and thus are modular, as shall be described further below. FIG. 9 shows a top view of base piece 610, which in this embodiment includes a head piece 612 and a body 614. FIG. 10 shows a bottom view of head piece 612 which may optionally be detachable, such as to allow the user to change the claws that are attached to body 614, or to exchange other head pieces onto the body 614. In other embodiments, the head piece 612 may be integral to base piece 610, or the base piece 610 may have other exchangeable components that may be inserted elsewhere on body 614. In the embodiment of FIGS. 9-10, the head piece 612 may be coupled to the body 614 placing it over body 614 and inserting the post 618 into hole 619 in body 614. Other methods of attaching head piece 612 to body 614 are possible, such as a replacing post 618 with a hole and inserting a fastener such as a screw or pin through the hole of head piece 612; having tabs or flanges on the head piece 612 or body 614 for clipping onto a mating component, or sliding one component onto another.

FIG. 9 also shows recesses 613*a*, 613*b* and 613*c* in the top surface of body 614 for attaching claws. In this embodiment, recesses 613*a*, 613*b* and 613*c* are exposed when head piece 612 is removed from body 614. In operation, a user may modify the number of claws that toy 600 is configured with. For example, a user may utilize only the two claws 621 and 622 (see, e.g., FIG. 1), with or without the head piece 612 on body 614. In such an embodiment, recesses 613*a*-613*c* would not be utilized. For a three-clawed arrangement, the user may remove the head piece 612 and insert an additional claw (e.g., claw 623 or 624 of FIG. 8) into recess 613*a*, 613*b* or 613*c*. The user may also utilize four claws, as shown in FIG. 8, by omitting the head piece 612 and inserting claws 623 and 624 into recesses 613*a* and 613*c*. Thus, it can be seen that recesses 613*a*, 613*b* and 613*c* offer increased play value by the enabling alteration of the toy's configuration as desired by the user. The recesses 613*a*, 613*b* and 613*c* are depicted as rectangular-type holes in this embodiment, but other shapes are possible that enable a desired movement path for claws 623 and 624 and that allow insertion of the claws. In yet other embodiments, one of the recesses, such as center recess 613*b*, may be utilized to allow a single mechanism operating through the recess 613*b* to move multiple claws attached to the body 614.

Figure 11:
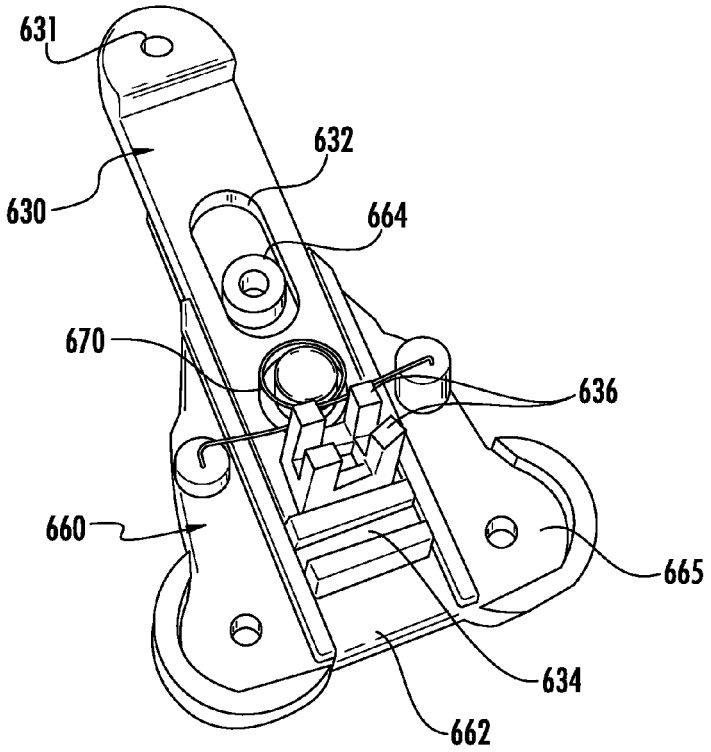
FIG. 11 shows an exemplary actuation element and plate.

FIG. 11 shows inner components of toy 600—an actuation element 630 that slides in a track 662 of a plate 660. Plate 660 is configured with a flat bottom, so that it may slide on a playing surface. In other embodiments, the base piece 610 may be configured in other ways to allow it to slide on a surface, such as having rounded nubs, wheels, or runners on its bottom surface. The choice of material for base piece 610, as well as any attached claws, may also facilitate the slidability of the toy. For instance, components of the toy may be manufactured from particular plastics, metals, wood, and coatings applied thereto to allow minimize friction between the toy and it supporting surface.

Actuation element 630 includes a hole 631 to which a tether such as a string may be attached. In this embodiment, a protrusion 664 on plate 660 slides in a slot 632 in actuation element 630. This interaction between protrusion 664 and slot 632 provides end limits to the travel of actuation element 630 between its closed and open positions. An optional spring 670 may be included in the assembly, to assist in maintaining actuation element 630 in its pulled out position so that the claws remain closed when actuated.

Actuation element 630 also includes a groove 634 and prongs 636, while plate 660 also includes receiving areas 665. Prongs 636 are joining elements to enable claws to be modular, as shall be described in relation to FIGS. 15-17. Receiving areas 665 receive linkages 625 of claws 621 and 622, shown in FIG. 12. In this embodiment of FIG. 12, linkages 625 are shaped as rings, with pins 626 at the ends. The pins 626 extend through the underside of the linkages 625, and are seated in the groove 634 of actuation element 630. Posts (not shown) on an underside of body 614 fit into the central holes of linkages 625, forming a pivot joint between body 614 of base piece 610 and claws 621 and 622.

Figure 12:
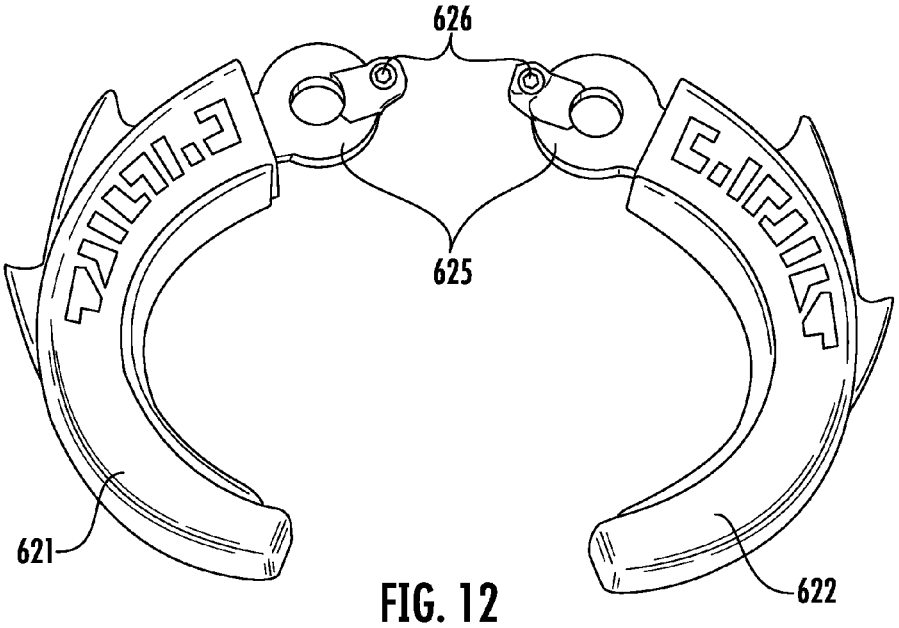
FIG. 12 provides a top view of exemplary claws.
Figure 13:
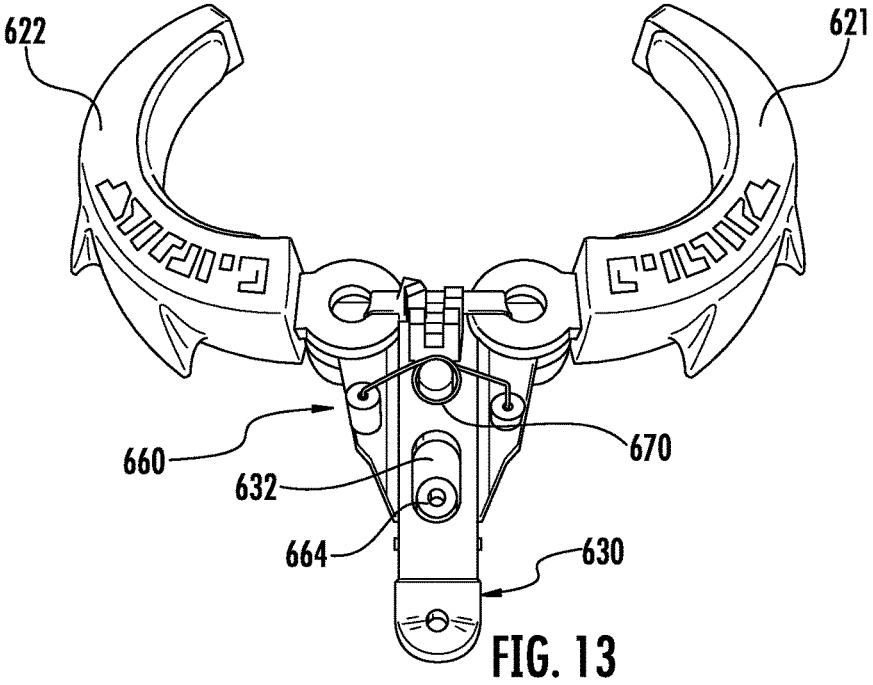
FIG. 13 shows the components of FIGS. 11 and 12 assembled together, with claws in a first position.
Figure 14:
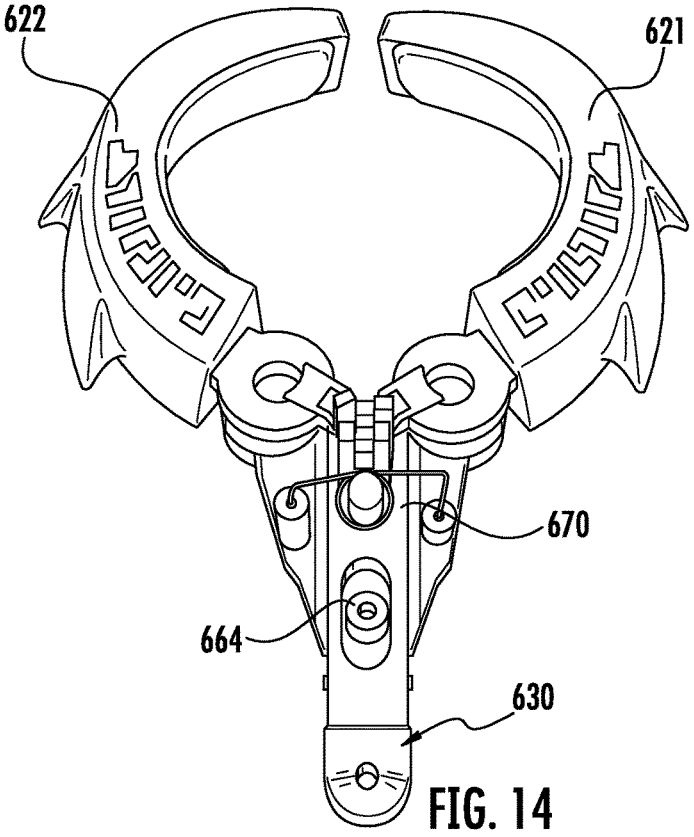
FIG. 14 shows the components of FIGS. 11 and 12 assembled together, with claws in a second position.

Assembled views of the components from FIGS. 11-12 are shown in FIGS. 13-14. Claws 621 and 622 are seated in receiving areas 665 of plate 660, where they will pivot when body 614 is assembled onto the toy. FIG. 13 shows the toy in its open position, with the ends of claws 621 and 622 expanded apart from each other. In this position actuation element 630 is pushed forward on plate 660, as evidenced by protrusion 664 being at an initial end of slot 632, and spring 670 being bowed. In FIG. 14 the actuation element 630 is in its outermost position, extended out from the plate 660, the pins 626 (FIG. 12, not visible in FIG. 14) are pulled by groove 634 of actuation element 630 (FIGS. 11-12), causing the claws 621 and 622 to contract toward each other. As can be seen in FIG. 14, actuation element 630 has been slid outward relative to protrusion 664, and spring 670 is in an unbiased state. Thus, FIGS. 13-14 demonstrate one embodiment in which pulling actuation element 630, such as through tension by a tether coupled to actuation element 630, causes claws 621 and 622 to move from an expanded to a contracted position.

In yet other embodiments (not shown), the claws may be coupled to the base piece with other types of movement instead of pivoting, such as with a sliding motion. For example, the claws may telescope in and out of the toy's base. When a user pulls on the tether, a portion of the claws are retracted into the toy's body, while the remainder of the length of the claws remain outside of the body to capture the target piece.

Figure 15:
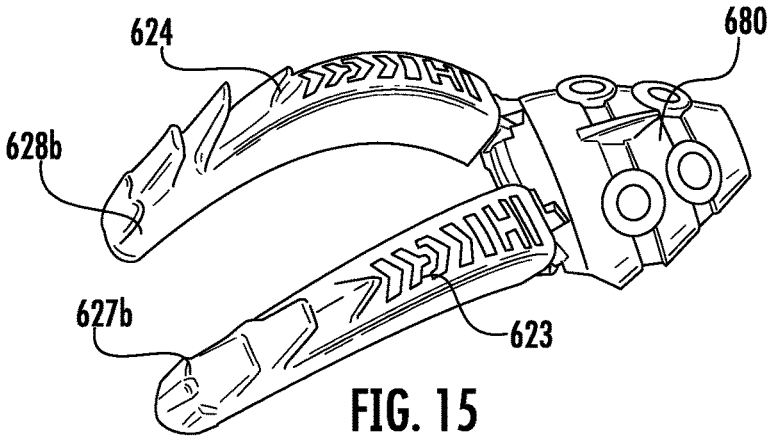
FIG. 15 is a perspective top view of an embodiment of modular claws.
Figure 16:
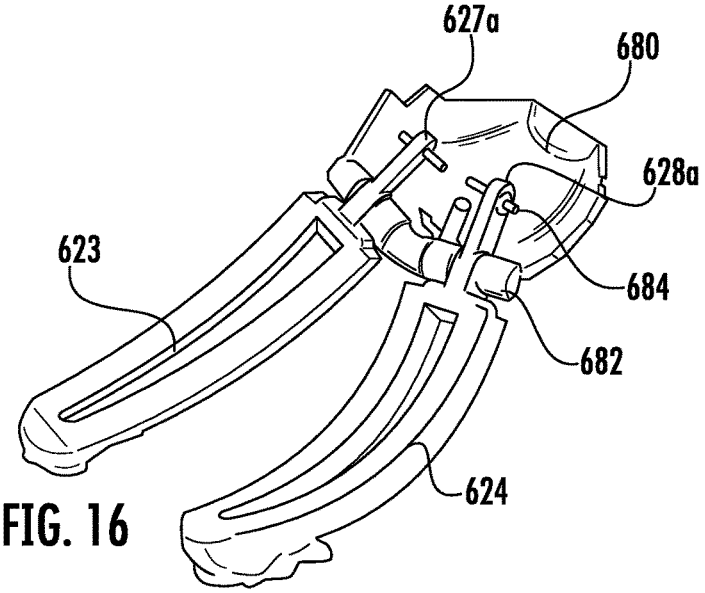
FIG. 16 is a perspective bottom view of the claws of FIG. 15.
Figure 17:
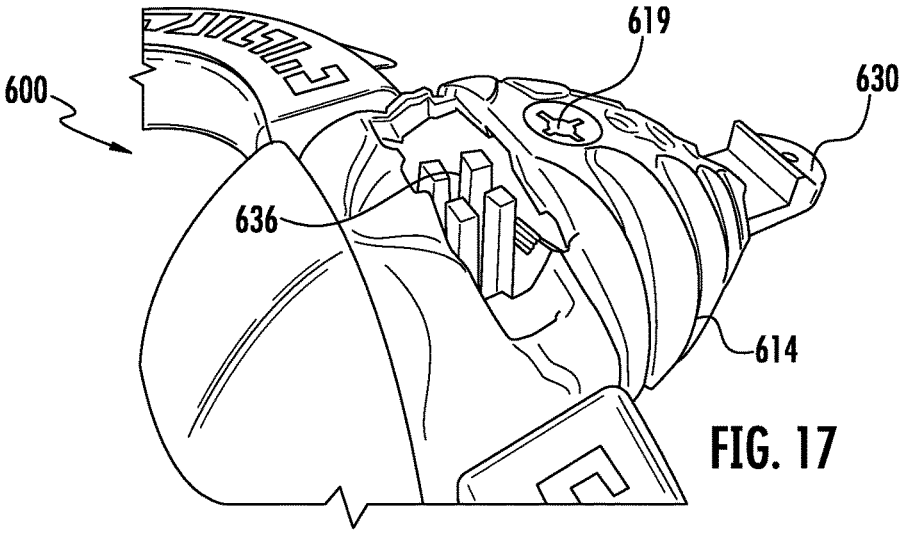
FIG. 17 shows an embodiment of coupling elements for the modular claws of FIG. 15.

FIGS. 15-17 depict yet another embodiment in which certain claws may be modular. FIG. 15 shows a top view and FIG. 16 shows a bottom view of removable claws 623 and 624 that are coupled to a shell piece 680 via pin joints 682. Claws 623 and 624 have first ends 627*a* and 628*a*, respectively, that extend under shell piece 680, with pins 684 placed in these first ends 627*a* and 628*a*. Pins 684 are insertable into the prongs 636 that are shown in FIG. 11, and which are also shown in the assembled toy 600 of FIG. 17. The prongs 636 and pins 684 assemble to form a horizontal pivot joint, so that the claws 623 and 624 rotate in an approximately vertical plane compared to the horizontal plane of claws 621 and 622. To attach the module claws 623 and 624, the actuation element 630 is placed in its forward position so that the prongs 636 are accessible through an opening in body 614 (e.g. recesses 613*a*, 613*b* or 613*c* of FIG. 9; the entire area of which is open in FIG. 17 for clarity). A user may then place the pins 684 between prongs 636. Shell piece 680 may be secured to body 614 to help attach claws 623 and 624 to the toy 600. In the embodiment of FIG. 17, a hole 619 in body 614 may be used to receive a mating protrusion (e.g., post 618 of FIG. 10) on shell piece 680. When the actuation element 630 is pulled, the prongs 636 move with the actuation element 630, thus causing the second ends 627*b* and 628*b* of claws 623 and 624 to contract toward each other and toward claws 621 and 622. Providing modular claws enhances play value by allowing a user to exchange claws of different designs, or to change the number of claws. Changing the number of claws may also allow players to change the level of play difficulty or to capture different types of objects, such as target pieces of various shapes and sizes. The claws may be coupled or decoupled from the toy as desired during the course of the game play.

Figure 18:
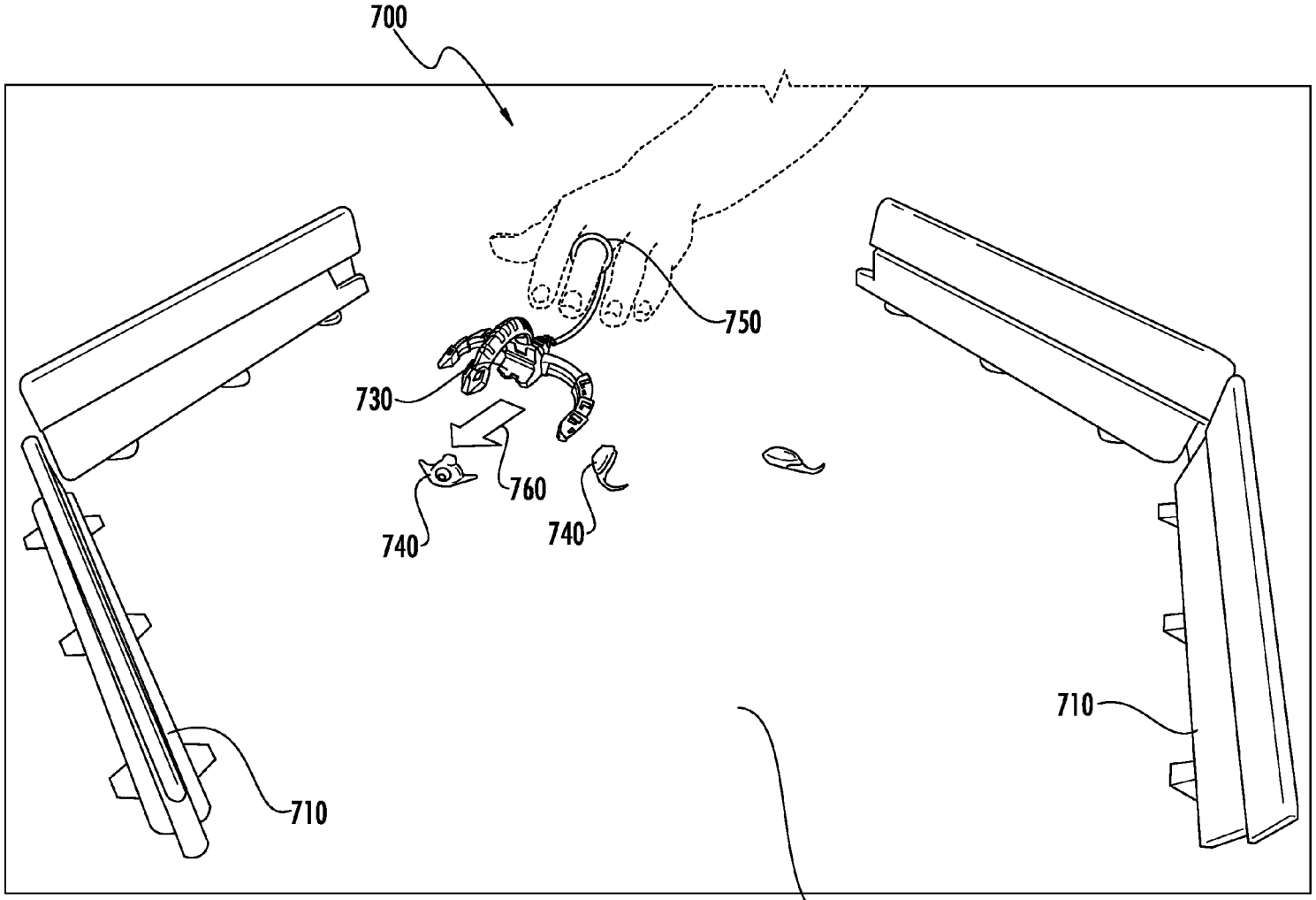
FIG. 18 shows an exemplary game system.

FIG. 18 shows an embodiment of a game system 700 using the retrieving toys described herein. The game system 700 may include an optional game arena 710 to define the playing space within which the retrieving assemblies 730 capture the target pieces 740. The game arena 710 is embodied here as vertical walls, with multiple segments that are placed on a playing surface 720, and that can be spaced apart and angled as desired. Playing surface 720 may be, for example, a tabletop, a floor, a game board, or other surface that is conducive to sliding objects on top of it. In other embodiments, the game arena 710 may be configured as, for example, curved border pieces, or posts. In various embodiments, the game arena may be separate from the playing surface or may be affixed to the playing surface.

In operation, a user slides a retrieving toy 730, with claws open, toward target pieces 740 as indicated by arrow 760. In FIG. 18, it can be seen that loop 750 is mounted on the user's hand, so that the user can maintain control of the tether attached to toy 730. If the toy 730 is slid accurately toward a target piece 740, the user pulls on the tether, thus closing the claws of toy 730 and capturing the piece. In one embodiment, players may race to capture as many target pieces 740 as possible, with the winner being the one to grab the most target pieces. In other embodiments, players may compete to capture certain colors or types of target pieces. Players may take turns capturing the pieces, or may compete simultaneously.

Figure 19:
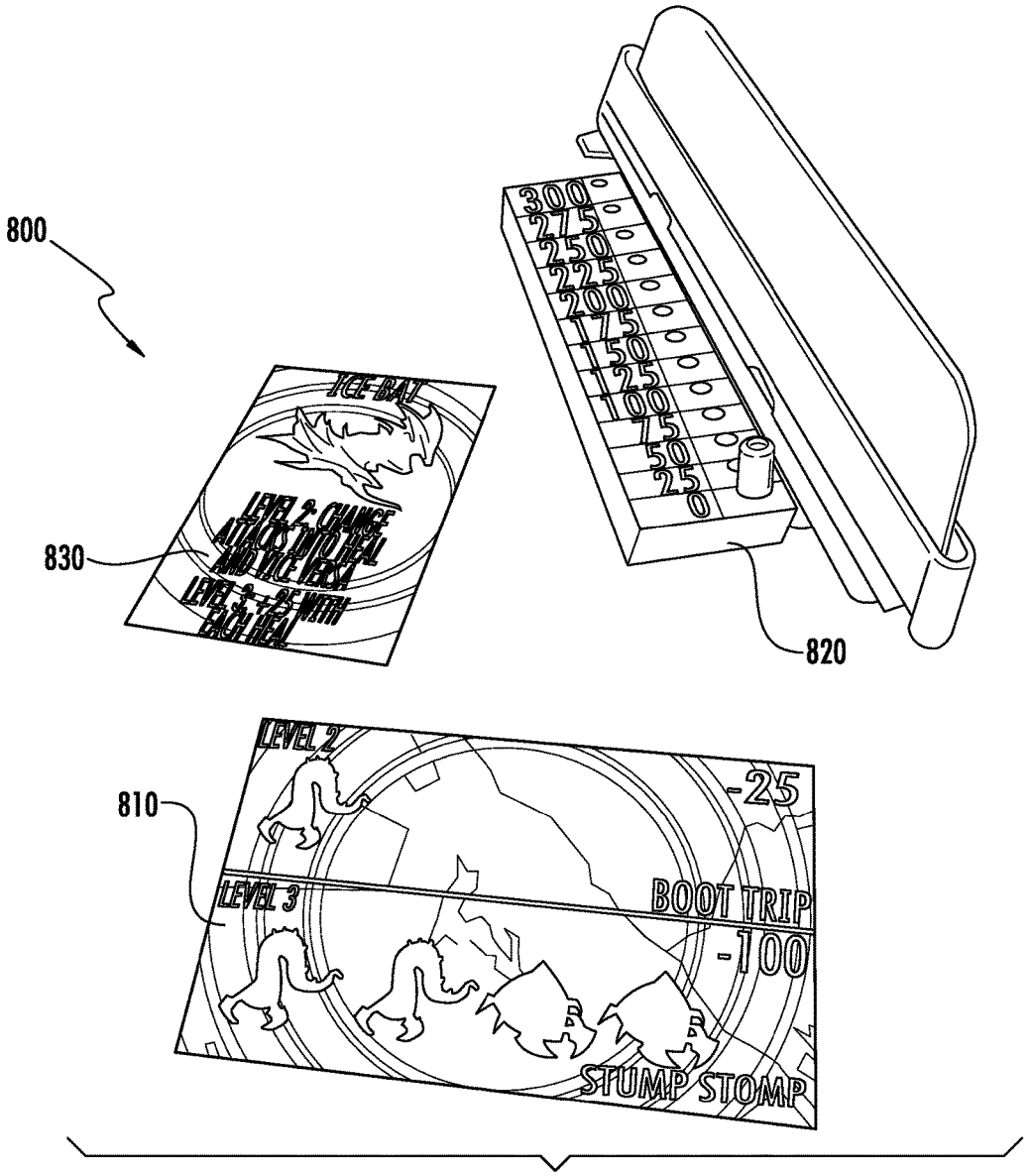
FIG. 19 illustrates an embodiment of game cards and a scoring element.

In yet further embodiments, a game system 800 in FIG. 19 may include game cards and a scoreboard. Exemplary game play may include claw figures as described above, target pieces, a game arena, action cards 810, a hit point status indicator 820 (e.g., a scoreboard), and character cards 830. The action cards 810 may indicate which target pieces are required for a particular action related to at least one of the target pieces. That is, the game cards, also referred to as action cards 810, may include instructions for conducting an action related to at least one of the target pieces. For example, one green target piece may be required to take twenty-five hit points from a player's opponent. Each player takes turns starting a round by placing one or more of their own target pieces into the game arena. The opposing player places a number of their target pieces into the game arena. During a competitive round, the players must battle to retrieve target pieces from the game arena by flinging their claw figures into the arena and activating the claws to grab the target pieces and bring them back to the player's side. Once the competitive round ends, the starting player uses their captured target pieces to activate an action on one of their action cards 810. Points are tracked on status indicator 820. The first player to reduce their opponent's hit points to zero wins.

While the specification has been described in detail with respect to specific embodiments of the invention, it will be appreciated that those skilled in the art, upon attaining an understanding of the foregoing, may readily conceive of alterations to, variations of, and equivalents to these embodiments. These and other modifications and variations to the present invention may be practiced by those of ordinary skill in the art, without departing from the scope of the present invention, which is more particularly set forth in the appended claims. Furthermore, those of ordinary skill in the art will appreciate that the foregoing description is by way of example only, and is not intended to limit the invention.

What is claimed is:

1. A toy apparatus comprising:

a base piece configured to freely slide on a surface due to momentum generated when an initial pushing force is applied to the toy apparatus;

a base elongated member coupled to the base piece, the base elongated member having a distal end away from the base piece;

a movable elongated member having a first end and a second end, the movable elongated member being coupled to the base piece near the first end and being movable with respect to the base piece between an open first position and a closed second position; and a tether coupled to the first end of the movable elongated member, wherein tension applied to the tether moves the movable elongated member from the open first position to the closed second position;

wherein in the open first position, the second end of the movable elongated member is away from the distal end of the base elongated member; and wherein in the closed second position, the second end of the movable elongated member is closer to the distal end of the base elongated member, and the base elongated member and the movable elongated member are capable of retaining a target piece.

2. The apparatus of claim 1 further comprising an actuation element coupling the tether to the movable elongated member, wherein the actuation element is slidably coupled to the base piece.

3. The apparatus of claim 1 wherein the base elongated member is fixedly coupled to the base piece.

4. The apparatus of claim 1 wherein in the closed second position, the base elongated member and the movable elongated member are configured to pinch the target piece between the distal end and the second end.

5. The apparatus of claim 1 wherein the base elongated member comprises a plurality of base elongated members, wherein in the closed second position the movable elongated member and the plurality of base elongated members are configured to surround the target piece.

6. The apparatus of claim 1 wherein the movable elongated member moves vertically relative to the surface when moving between the open first position and the closed second position.

7. The apparatus of claim 1 wherein the tether extends from the base piece, and wherein the tension that moves the movable elongated member from the open first position to the closed second position is applied only to the tether.

8. The apparatus of claim 1 wherein the movable elongated member moves from the open first position to the closed second position only due to the tension applied by the tether, and without other human contact to the toy apparatus.

9. A game apparatus comprising:

a plurality of target pieces; and a plurality of retrieving assemblies comprising:

a base piece configured to freely slide on a surface due to momentum generated when an initial pushing force is applied to the retrieving assembly;

a base elongated member coupled to the base piece, the base elongated member having a distal end away from the base piece;

a movable elongated member having a first end and a second end, the movable elongated member being movably coupled to the base piece near the first end; and a tether coupled to the first end of the movable elongated member and extending from the base piece;

wherein the movable elongated member has an open first position in which the second end of the movable elongated member is away from the distal end of the base elongated member;

wherein the movable elongated member has a closed second position in which the second end of the movable elongated member is closer to the distal end of the base elongated member, and wherein in the closed second position the base elongated member and the movable elongated member are capable of retaining a target piece of the plurality of target pieces; and wherein tension applied to the tether moves the movable elongated member from the open first position to the closed second position.

10. The apparatus of claim 9 further comprising a plurality of game cards, wherein the game cards include instructions for conducting an action related to at least one of the target pieces.

11. The apparatus of claim 9 further comprising a game arena, wherein the game arena defines a space within which the retrieving assemblies capture the target pieces.

12. The apparatus of claim 9 wherein the base elongated member is fixedly coupled to the base piece.

13. The apparatus of claim 9 wherein the retrieving assemblies further comprise an actuation element coupling the tether to the movable elongated member, wherein the actuation element is slidably coupled to the base piece.

14. The apparatus of claim 9 wherein the movable elongated member is pivotally joined to the base piece.

15. The apparatus of claim 9 wherein the movable elongated member moves vertically relative to the surface when moving between the open first position and the closed second position.

16. The apparatus of claim 9 wherein the tension that moves the movable elongated member from the open first position to the closed second position is applied only to the tether.

17. The apparatus of claim 9 further comprising a user control device coupled to the tether.

18. The apparatus of claim 17 wherein the user control device comprises one of the group consisting of a loop, a handle, and a knob.

* * * * *